US005904084A

United States Patent [19]

Weston

[11] Patent Number: 5,904,084

[45] **Date of Patent: *May 18, 1999**

[54] CUTTING APPARATUS

[76] Inventor: Frank William Weston, 17 Oliver Road, St. Helens, Merseyside WA10 3EW, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/773,409

[22] Filed: Dec. 27, 1996

Related U.S. Application Data

[63] Continuation of application No. 08/301,356, Sep. 6, 1994, abandoned.

[30] Foreign Application Priority Data

Feb. 4, 1994 [GB] United Kingdom ..... 9402108

[51] Int. Cl.[6] ..... B26D 7/00

[52] U.S. Cl. ..... 83/373; 83/452; 83/453; 83/486.1; 83/733

[58] Field of Search ..... 83/452, 410.7, 83/733, 373, 453, 614, 581, 474, 486.1, 485, 471.3

[56] References Cited

U.S. PATENT DOCUMENTS 4,407,074 10/1983 Ledbetter ..... 33/27.08
5,009,138 4/1991 Rettie ..... 83/413

FOREIGN PATENT DOCUMENTS 196383 10/1986 European Pat. Off. .
2264666 9/1993 United Kingdom .

*Primary Examiner*—M. Rachuba
*Attorney, Agent, or Firm*—Higgs, Fletcher & Mack LLP; Bernard L. Kleinke

[57] ABSTRACT

An apparatus and method for cutting sheet material in which the apparatus comprises a turntable, a cutter guide and a cutter mounted on and moveable along the cutter guide. A piece of sheet material to be cut is mounted on the turntable and a straight line is cut in the material by keeping the turntable stationary and pressing the cutter into the card and moving it along the guide. An arch is cut in the card by rotating the turntable underneath the stationary cutter. The movement of the turntable is limited by a pair of stoppers. Stoppers are provided for limiting the travel of the cutter.

17 Claims, 7 Drawing Sheets

CUTTING APPARATUS

This application is a continuation of application Ser. No. 08/301,356 filed Sep. 6, 1994, now abandoned.

BACKGROUND OF THE INVENTION

1. Field of the Invention

The present invention relates to a cutting apparatus, and in particular, but not exclusively, to cutting apparatus for cutting sheet material.

2. Description of the Prior Art

When framing pictures and photographs it is usual for a piece of sheet material or cut card, known as a mountboard, to be inserted between the picture or photograph and a glass cover plate. The mountboard is provided with an aperture through which the picture or photograph can be viewed. The aperture may be e.g., square, rectangular, circular, oval or arch-shaped, and is usually provided with a bevelled edge to enhance the aesthetic appeal of the mountboard.

If a bevelled edge is desired this is achieved simply by mounting the blade of a cutter at the desired angle of bevelling relative to the planar surface of a mountboard to be cut. The angle of bevelling is normally about 45° if the mountboard is cut from the front, but it can be about 135° if it is cut from the rear of the card.

Square and rectangular holes in mountboards can be achieved fairly simply and quickly by a skilled operator simply by sliding a cutter along a straight edge and repeating the process until the desired shape has been achieved. This process can be used for all polygonal shapes.

Circular and elliptical shapes can be cut by using appropriate templates. However, cut mountboards produced by such methods tend to take a long time to produce, and to be of poor quality so that sanding down of the mountboard is generally necessary in order to achieve an acceptable finish.

In order to overcome these problems machines have been devised wherein an integrally mounted blade is rotated relative to a piece of board to be cut to produce a desired shape of mountboard. Circles can be cut by machines in which the blade is rotatably mounted about a central pivot. Ellipses can be cut by more complex machines in which a combination of rotational and translational movement is used to produce a desired ellipse.

There has, however, been a long-standing problem in cutting acceptable arch mountboards, more particularly, in producing mountboards which define holes known as cathedral arches. The term "cathedral arch" is used herein to refer to an arch which has an arcuate, for example, a substantially semicircular, top, substantially parallel sides which extend from the top and a base which is substantially perpendicular to each of the substantially parallel sides. The term "the arch of a cathedral arch" is used herein to refer to the top and the sides of the cathedral arch, as defined above, but not the base.

Cathedral arches are extremely difficult to cut accurately using a template and therefore recourse has been made to machine cutting techniques. More particularly, it is known to cut cathedral arches by a process in which a circle is first cut out of a piece of card and then, starting from two diametrically opposed points on the circle, two parallel longitudinal cuts are made in the card. The cuts are each of substantially the same length and so the cathedral arch can be completed by using a straight-edge guide to join the ends of the two longitudinal cuts.

This method is however time consuming to perform since it requires several independent operations to be performed.

Furthermore, it requires a skilled operator in order to ensure that the finished product is acceptable, since small deviations from an ideal cutting line can result in a large reduction in the quantity of finish and therefore in the commercial value of the product. It is also difficult to keep the cutter at a constant depth of contact with the mountboard. Even if the method is performed by a skilled operator it is often the case that unsightly protrusions or indentations are visible in the region where the longitudinal cuts join the circumference of the pre-cut circle. Sanding down of these regions with a fine emery paper is thus usually required to produce a smooth finish, further adding to the cost and the time required to produce an acceptable product.

The above-mentioned disadvantages are further apparent when, as is normally the case, it is desired to cut a cathedral arch with a bevelled edge in order to produce an attractive finish to a mountboard. The bevelled edge is often a white or a light colour for contrast with a dark surface of the mounting board. This edge is thus highlighted so that any imperfections, even if small, can usually be easily seen. Since mountboards are used for displaying photographs and pictures in an attractive setting it is important that the finished mountboard should have as few imperfections as possible.

In view of the above-mentioned difficulties in cutting good quality cathedral arches, mountboards having such arches attract a price premium over those with circular or elliptical holes.

It is an object o the present invention to provide a cutting apparatus which overcomes or alleviates the abovementioned problems.

It is a further object of the present invention to provide a cutting apparatus which enable the arch of a cathedral arch in a mountboard to be cut without having to remove a cutting member from cutting engagement with the mountboard.

In accordance with a first aspect of the present invention, there is provided a card-cutting apparatus for cutting sheet material, comprising a pivotally mounted turntable upon which, in use, the sheet material to be cut is mounted, a cutter guide mounted above the turntable, a cutter movable along the cutter guide, and at least one rest which is engageable with the turntable to limit the rotation of the turntable.

The term "above the turntable" when used herein means "above the level of the turntable" and is not limited to positions directly above the turntable.

By using the above apparatus, the arch of a cathedral arch may be formed in a card by cutting a first straight edge in the card using a cutter guided by the cutter guide, rotating the turntable through 180° while keeping the cutter in cutting contact with the card and cutting a second straight edge without removing the cutter from the card.

Preferably, the cutter guide comprises a substantially straight edge and preferably the turntable is rotatable through at least 180°, to enable conventional cathedral arches to be formed.

In use the substantially straight edge should be positioned so that a normal to the substantially straight edge passes through a pivot about which the turntable is pivotally mounted.

The apparatus may comprise one or more stoppers which are engageable with the turntable to limit the pivoting of the turntable to one or more (e.g. two or three) stoppers may also be provided, mounted along or adjacent the substantially straight edge so that when a cutter is slid along the substantially straight edge the stoppers can be used to prevent it travelling further in a particular direction. The stoppers may be slidably mounted along a member having the straight edge. Desirably the stoppers can be clamped or otherwise fixed in position relative to the substantially straight edge. There may be first, second and third stoppers along or adjacent the substantially straight edge so that when a cutter is placed contacting the first stopper, slid along the substantially straight edge until it contacts the second stopper and, after removing the second stopper from the path of the cutter, slid along the straight edge until it contacts the third stopper, the distance travelled by the cutter between the first and second and second and third stopper is substantially the same. For convenience the second stopper may be pivotally mounted e.g. by hinging so that in a stopping position it prevents the cutter from travelling along the substantially straight edge but, by pivoting the stopper about the hinge, the stopper can be removed from the path of the cutter to allow the cutter to be slid along the substantially straight edge. Desirably the second stopper is positioned to stop the cutter cutting into the mountboard at a point which has along the normal from the substantially straight edge to the pivot about which the turntable is pivotally mounted.

Desirably there are provided spaced markings at or adjacent the substantially straight edge which indicate distance along the straight edge. These markings may be closely spaced for accuracy, e.g. at millimetre intervals, and may be used for positioning the stoppers. It is not essential for stoppers to be provided for interrupting the paths of the cutter along the substantially straight edge since, for example, the markings can provide appropriate indicators for stopping the path of a cutter along the substantially straight edge.

The substantially straight edge may be an edge of an elongate member, e.g. a rule, which member may be slidably mounted on a frame so that the substantially straight edge can be moved closer to or further away from the pivot of the pivotally mounted turntable, as desired.

Means e.g. clamps or screws may be provided for releasably fixing the elongate member in position relative to the pivot when the elongate member has been positioned as desired.

The apparatus may be provided with its own cutter which may be slidably mounted to the elongate member. The blade of the cutter is desirably offset to cut a bevelled edge when in use. The angle of offsetting may be adjustable so that a desired angle of bevel can be achieved.

The turntable is preferably provided with means for supporting a mountboard during cutting of the mountboard e.g. it may be provided with a plurality of spaced pins or tacks, which are desirably removably mounted to the mountboard.

Preferably the blade of the cutter is offset to produce bevelled edge. Desirably the angle at which the blade of the cutter is offset relative to card to be cut is 30° to 60° or 120° to 150°, more preferably substantially 45° or substantially 135°. These two alternatives are desired since a piece of card can be cut from either the front or from the back (a blade angled at 45° when cutting card from the front will produce the same angle of bevel as a blade angled at 135° when cutting card from the rear).

Standard cutters can be used with the apparatus of the present invention, if desired. A specially adapted cutter alternatively can be used which allows cathedral arches of narrow width to be produced.

Preferably there is provided a cutter comprising a cutter body having a substantially planar, horizontal undersurface for sliding across a mountboard to be cut, a first substantially, straight edge slidable along a cutter guide, a cutting blade pivotally mounted on a mounting plate of the cutter body and being pivotable from a non-cutting position to a cutting position in which it projects beneath the planar undersurface of the cutter body, wherein the mounting plate projects beyond said planar horizontal undersurface.

Desirably the cutter comprises a second edge opposite the first edge and a blade pivotally mounted for pivoting about a plane. Preferably this plane is at an angle of between 100° and 170° relative to said planar surface. Desirably when the blade is in cutting engagement with a mountboard the maximum distance between the blade and the second edge when measured along a normal to the first edge is less than 10 mm.

Preferably the plane of pivoting of the blade is at an angle of substantially 135° relative to the planar surface. The distance between the blade and the second edge can be e.g. from 10 mm to 0.5 mm, more preferably from 5 mm to 1 mm.

The cutter may be generally "V" shaped in cross-section and may have a counterweight above said planar base surface to prevent the cutter toppling over due to the weight of the blade and its mounting. The counterweight may be shaped to form a handle of the cutter.

The cutter of the present invention is advantageous in that it allows the blade to cut into mountboard close to the second edge. This allows the 180° pivoting of the card relative to the cutter to occur with only a small radius of pivot (as required when cutting a narrow arch) without the second edge interferring with mounting pins or other means used to hold the mountboard in position during the cutting process.

In accordance with a second aspect of the present invention there is provided a cutting apparatus comprising a pivotally mounted turntable upon which, in use, the sheet material to be cut is mounted, at least one adjustable clamp which at least partially extends over the sheet material to hold it in place during the cutting operation, a cutter guide mounted above the turntable, a cutter movable along the cutter guide and at least one rest which is engageable with the turntable to limit the rotation of the turntable.

This has the advantage that the sheet material is firmly held in place during the cutting operation and is therefore prevented from slipping during the cutting process. The provision of the clamping means has the advantage over using spikes to impale the sheet material on the turntable because it does not destroy a section of the sheet material by impaling it on spikes, thereby rendering any portions of the sheet material cut from the main section reusable. Furthermore, if a backing card is used the, sheet material and the backing card can be firmly clamped together avoiding the possibility of the sheet material moving during the cutting process.

Preferably, the at least one clamping means is a handle which is used to rotate the turntable. This has the advantage that the number of components of the cutting apparatus is reduced.

Preferably, the at least one clamping means forms an alignment means for the sheet material. This has the advantage that the clamping means doubles as an alignment means to ensure that the sheet material is correctly aligned on the turntable.

In accordance with a second aspect of the present invention, the cutter guide is pivotally mounted over the turntable. This has the advantage that the cutter guide can be lifted away from the turntable for the purpose of clamping the sheet material to the turntable, and can be rotated back to position above the turntable before commencing the cutting operation.

In accordance with a third aspect of the present invention, the cutter is attached to the cutter guide. This has the advantage that the cutter can be smoothly slid along the cutter without wobble and that a constant depth of cut is obtained.

Preferably the cutter has a spring loaded blade which cuts into the sheet material when pressure is applied to the cutter and a smoothing means which contacts the surface of the sheet material. This has the advantage that the smoothing means effectively irons out irregularities in the sheet material before it is cut by the blade. Furthermore, the smoothing means forms a steadier which helps keep the depth to which the blade contacts the sheet material constant when pressure is applied to the cutter.

In accordance with a fourth aspect of the present invention, a detent means is provided on the cutter guide to form a removable stopper for the cutter. This has the advantage that the cutter is automatically stopped by the detent means on the cutter guide so that the cutter can be kept still whilst the turntable is rotated beneath it. Furthermore, the detent means is disengaged by simply pushing on the cutter, this removes the need to remove a hand from the cutter in order to release the cutter from its stopped position, thereby allowing a more steady pressure to be maintained on the cutter.

In accordance with a fifth aspect of the present invention, the turntable has at least one detent means which holds the turntable in place when the turntable engages the at least one rest which limits the rotation of the turntable. This has the advantage that the turntable is held in place without the need to hold the handle and push the turntable into engagement with the rest.

BRIEF DESCRIPTION OF THE DRAWINGS

The present invention will now be described by way of example only, with reference to the accompanying drawings, wherein.

DETAILED DESCRIPTION OF THE INVENTION AND PREFERRED EMBODIMENTS THEREOF

Figure 1:
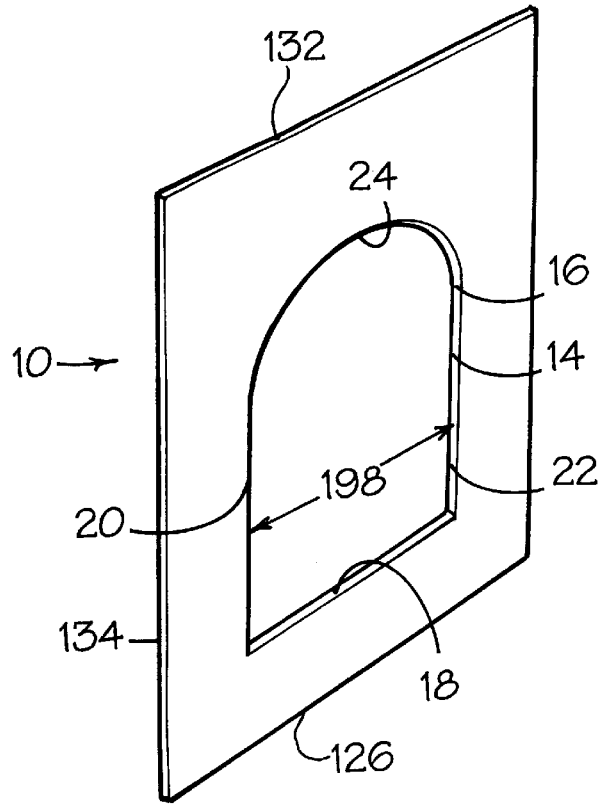
FIG. 1 is a perspective view of a mountboard having a cathedral arch which was cut using an apparatus of the present invention.

Referring now to FIG. 1, mountboard 10 has a standard rectangular outer perimeter for insertion in a rectangular frame, as well as an inwardly bevelled inner perimeter 14 which defines a cathedral arch 16; the angle of bevelling being about 45°.

Cathedral arch 16 comprises base 18, opposing parallel sides 20 and 22 and semi-circular top 24. As can be seen from the bevelled edge shown at the right-hand side of the drawing, there is no discontinuity or irregularity where side 22 and top 24 meet, a smooth finish being evident. Indeed, bevelled inner perimeter 14 is smooth and continuous along the whole of side 22, top 24 and side 20, since this part of the perimeter is cut by a cutting action in which a cutting blade is not removed from mountboard 10 whilst cutting.

Figure 2:
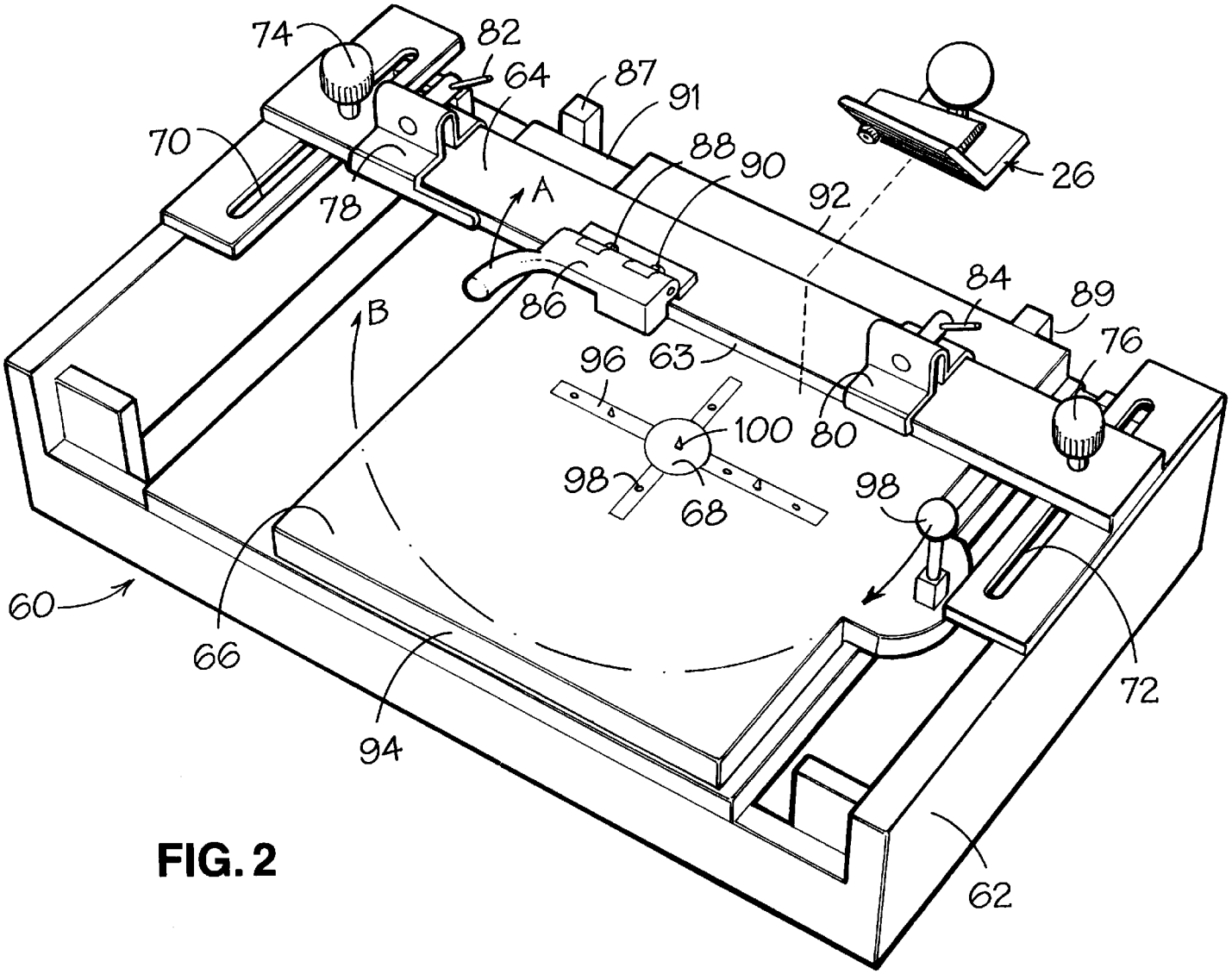
FIG. 2 is a perspective view showing an apparatus constructed in accordance with one embodiment of the present invention as well as a starting position which could be adapted by a cutter used with the apparatus with respect to the apparatus when the cutter is in use.

FIG. 2 is a perspective view of an apparatus 60 of the present invention. The position of a cutter 26 relative to apparatus 60 is shown at the point where the cutter would be used to commence cutting. Cutter 26 is shown in more detail in FIG. 3.

Apparatus 60 comprises rectangular frame 62, guide rule 64, which is slidably mounted to frame 62, and turntable 66 which is pivotally mounted to frame 62 about pivot 68.

Guide rule 64 is slidably mounted on frame 62 and can be slid along grooves 70 and 72 into a desired position. Screws 74 and 76 can then be used to fix the position of guide rule 54 relative to frame 62.

Stoppers 78 and 80 are slidably mounted upon guide rule 64 and can be fixed in position relative to guide rule 54 by turning handles 82 and 84, thereby causing the stoppers to grip guide rule 54.

Hinged stopper 86 is also mounted upon guide rule 64, but in this case is fixedly mounted by screws 88 and 90. Stopper 86 can be pivoted about its hinge in the direction indicated by arrow A so that it would no longer obstruct the passage of a cutter 26 being slid along edge 63 of guide rule 64.

Turntable 66 comprises a generally square board which is mounted for pivoting through 180°. Frame 62 is provided with two stoppers 87 and 89 along edge 91 which serve to limit the pivoting action to 180° by abutting edge 92 or edge 94 of turntable 66.

Turntable 66 is provided with a handle 98 for gripping by an operator. The turntable can thus be readily pivoted through 180° by moving handle 98 through arc B until the stoppers along edge 91 prevent further pivoting.

Turntable 66 further comprises cruciform mounting block 96, which is provided with a plurality of holes 98 into which mounting tacks 100 can be removably inserted. In use, the tacks are arranged so as to receive a predetermined size of card, and then a backing card is placed onto the tacks 100 so that the points of these tacks only protrude slightly through the backing card. A mountboard to be cut is then placed over the backing card so that there are two layers of card held in position by mounting block 96. The blade 32 of cutter 26 is pre-set so that it can cut through the thickness of the mounting board but not completely through the backing card, thus preventing damage to the blade 32 which could arise if it were to cut into turntable 66.

Figure 3:
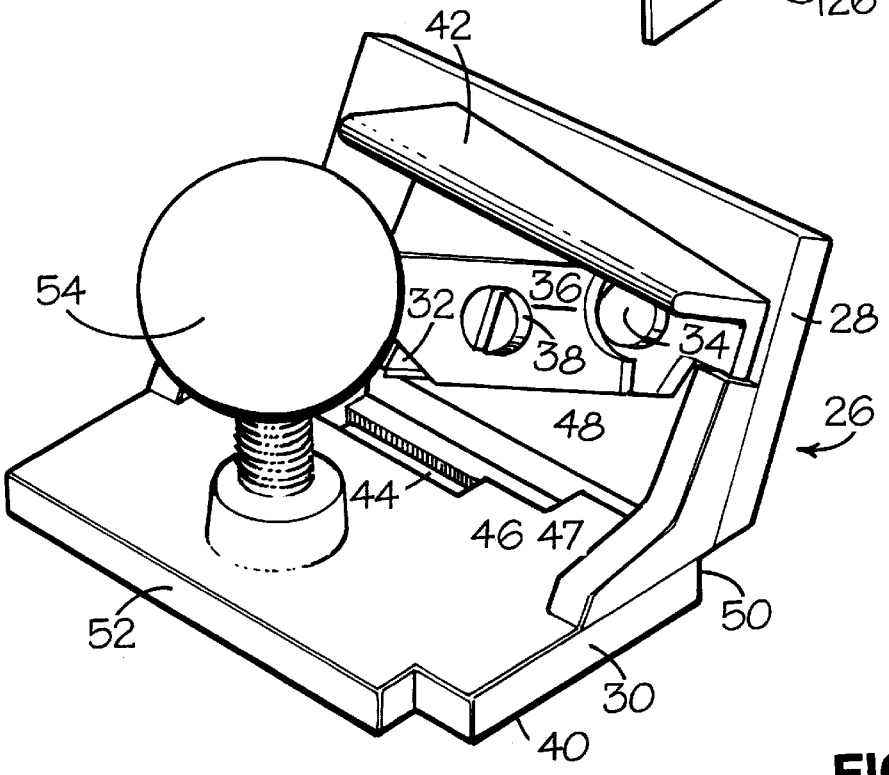
FIG. 3 is a perspective view of a cutter which can be used in conjunction with the apparatus of FIG. 1 and which is specially adapted so that cathedral arches can be readily cut in which the arch of the cathedral arch has a small radius.

FIG. 3 shows cutter 26 which can be used together with the apparatus of the present invention to cut cathedral arch 16.

Cutter 26 comprises generally rectangular metal blocks 28 and 30, which are offset from each other at an angle of about 135°. A blade 32 is pivotally mounted on block 28 by pivot 34 and can be removed from casing 36 by unscrewing screw 38. Block 30 has a planar lower surface 40 which contacts the surface of a card to be cut when the cutter is in use.

Thumb-rest 42 is also provided, by which downward pressure on blade 32 can be exerted. This allows blade 32 to be pivoted about pivot 34 so as to protrude through a slot 44, in block 30 below the level of lower surface 40 of block 30. Block 30 has shoulders 46 and 47 which serve to limit the pivoting of blade 32 by abutting bottom edge 48 of casing 36 when blade 32 has been pivoted downwardly to a certain extent. The maximum depth of cut can thus be predetermined.

Blade 32 is located parallel to and less than a centimeter (e.g. substantially 5 mm) from a longitudinal edge 50 of block 30 (when measured along an axis perpendicular to edge 52). Edge 52 can be slid along or guide rule whilst blade 32 cuts into a piece of mountboard. The proximity of blade 32 to edge 50 is advantageous in that it enables semicircular cuts of small radius to be made. This contrasts with conventional cutters in which the blade is mounted parallel to two straight edges of a base plate but in which both of the edges are over a centimetre from the blade so that the edges prevent the cutting of circular or arch-shapes of small radius.

Cutter 26 is provided with spherical handle 54 which also serves as a counterweight so that the cutter is stable when in use. Blade 32 of cutter 26 is also provided with spring loading (not shown) whereby when downward pressure on thumbrest 42 ceases, blade 32 automatically pivots back to a rest position in which it is disengaged from any card being cut.

FIGS. 4 to 7 show sequential plan views of the apparatus of the present invention shown in FIG. 2 and the cutter shown in FIG. 3 when in use to cut a cathedral arch.

Figure 4:
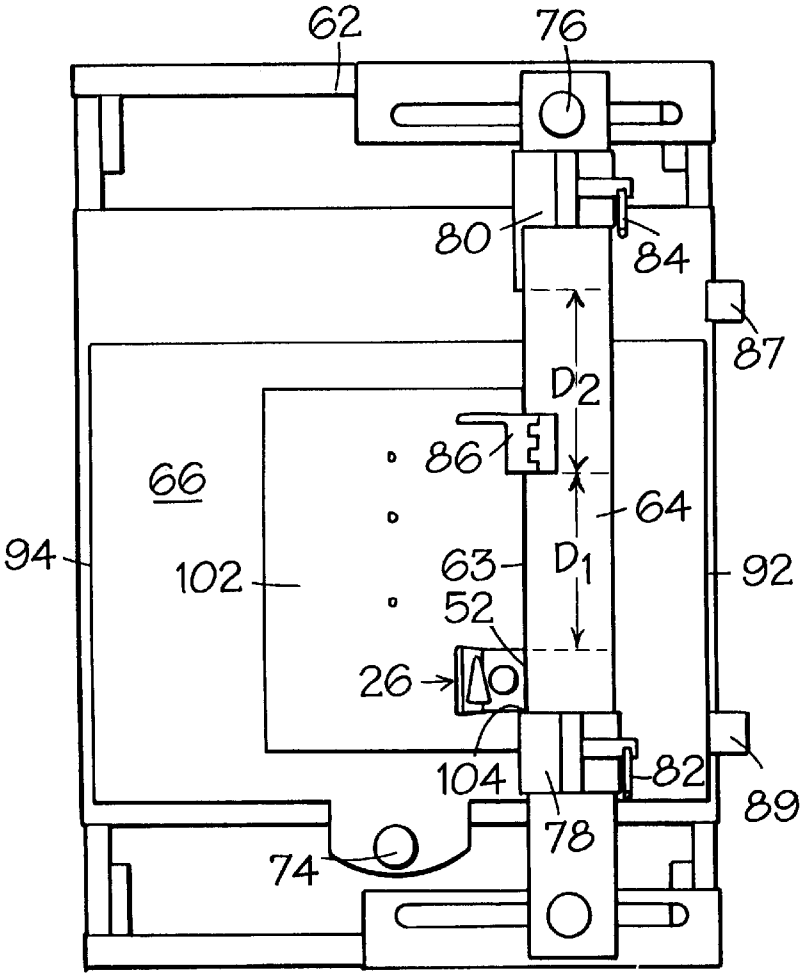

In Fig. 4 an un-cut rectangular mountboard 102 is shown positioned on mounting block 96 with the longest edges of the mountboard lying parallel to edge 63 of guide rule 64. Although one of the edges of mountboard 102 is shown as being coaxial with edge 63 of guide rule 64, this is not necessary since, depending upon the width of arch desired to be cut, guide rule 64 can be slid along slots 70 and 72 and fixed in any desired position along these slots in which it lies parallel to the longest edges of the rectangular mountboard 102.

Indeed it will be appreciated by those skilled in the art that it is not essential to mount mountboard 102 in this manner since, for example, it can be mounted with its two shorter parallel edges lying parallel to edge 63.

In the view shown in FIG. 4, screws 74 and 76 have been tightened so that guide rule 64 is fixedly mounted to frame 62. Similarly, levers 82 and 84 are tightened so that stoppers 78 and 80 are fixedly mounted to guide rule 64.

Distances D1 and D2 have been predetermined. Since these distances will be the lengths of the sides of the cathedral arch to be cut, D1 and D2 are therefore equal.

Cutter 26 is shown at a starting position in which it lies with edge 52 abutting edge 63 of guide rule 64 and in which corner 104 abuts stopper 82.

When an operator is ready to commence cutting he grips handle 74 and thereby keeps the edge of the turntable in contact with stopper 89 and thus ensuring that turntable 66 is not free to pivot.

Whilst maintaining turntable 66 in this position, the operator then presses down on thumbrest 42 of cutter 26 to engage blade 32 so as to cut into mountboard 102. The cutter 26 is then slid along edge 63 of guide rule 64 to produce a cut as shown in FIG. 4.

Figure 5:
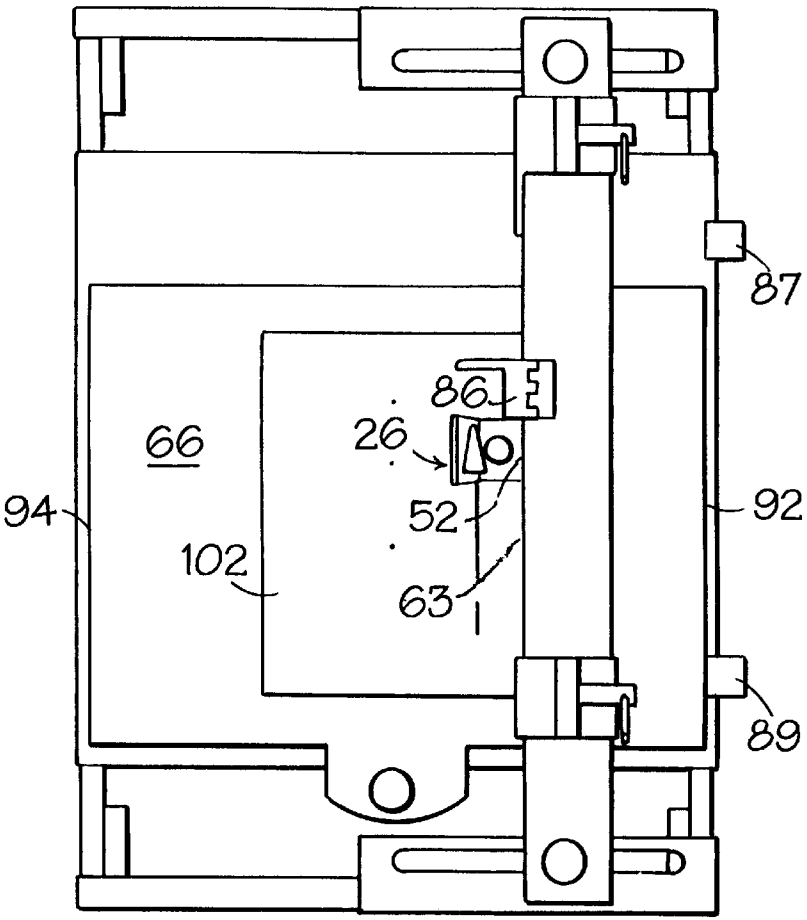
FIGS. 4, 5, 6 and 7 are sequential plan views showing the apparatus of FIG. 2 and the cutter of FIG. 3 being used to cut a cathedral arch in a mountboard.

In FIG. 5 the cutter 26 is shown coming into abutment with hinged stopper 86. This indicates to an operator that the top of one of the side walls of the cathedral arch has been reached and that turntable 66 should now be pivoted through 180° to produce the semicircular top of the arch.

Figure 6:
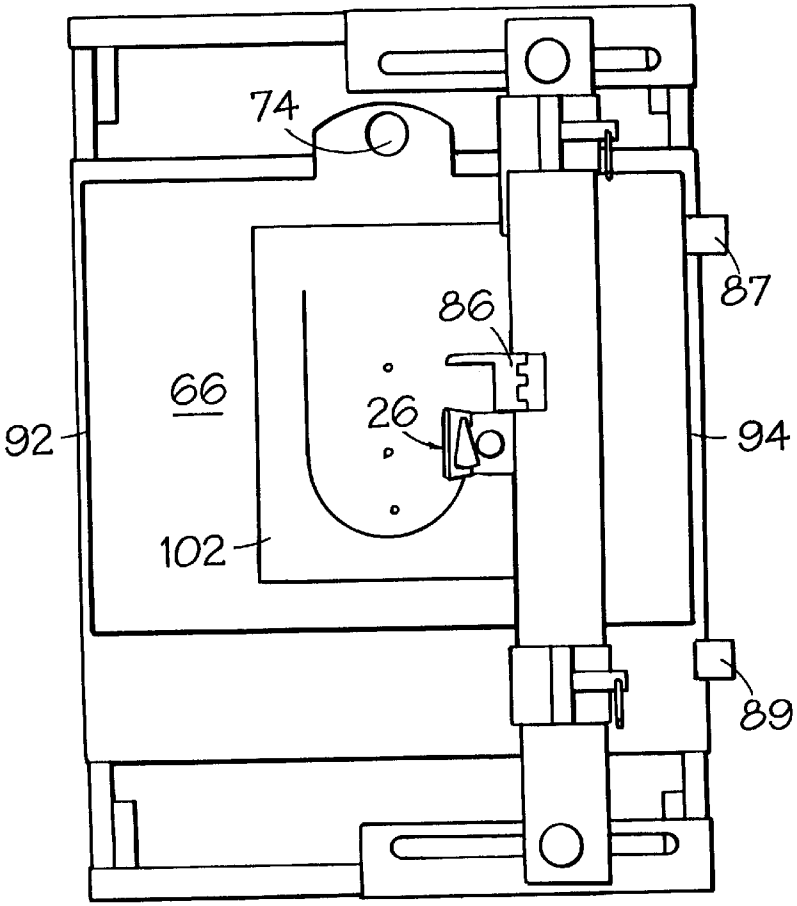

At this point the operator maintains cutter 26, with blade 32 still engaged in mountboard 102, in fixed position relative to guide rule 64 and pivots turntable 66 through 180° so that the cut is extended to the point indicated in FIG. 6. At this point stopper 87 abuts edge 94 of turntable 66, thus preventing further pivoting of turntable 66 in the same direction.

Figure 7:
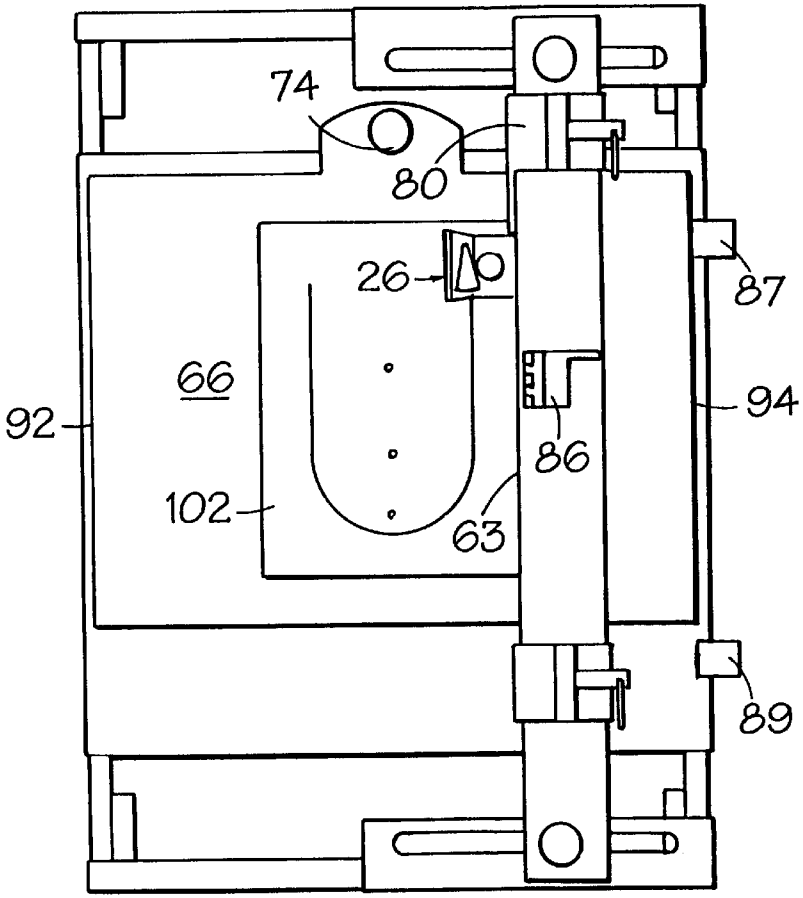

Hinged stopper 86 is then pivoted to the position shown in FIG. 7 allowing cutter 26 to be slid along guide rule 64 until it abuts stopper 86. During this action the operator uses handle 74 of turntable 66 to keep edge 94 in contact with stopper 87, thereby preventing turntable 66 from pivoting further in the same direction.

At this point the arch of the cathedral arch has been cut, as shown in FIG. 7. It is only then necessary to cut the base of the arch. This can be done by conventional cutting techniques in which an inclined blade is slid along a straight edge. A completed cathedral arch shape has then been cut and when mountboard 102 is removed from turntable 66, this shape will either fall away from the rest of the mountboard to leave a central arch shaped hole 9 as shown in FIG. 1), or this can be achieved by applying light pressure to the centre of mountboard 102.

The angle at which blade 32 is set during the cutting process ensures that the mountboard 102 is cut from the rear (the bevel being viewable from the front of the mountboard). This is advantageous in that the front side of the finished mountboard has a smoother finish than would otherwise be the case.

It is however possible to cut from the front of the mountboard, in which case the angle of bevel is desirably about 45°.

Figure 8:
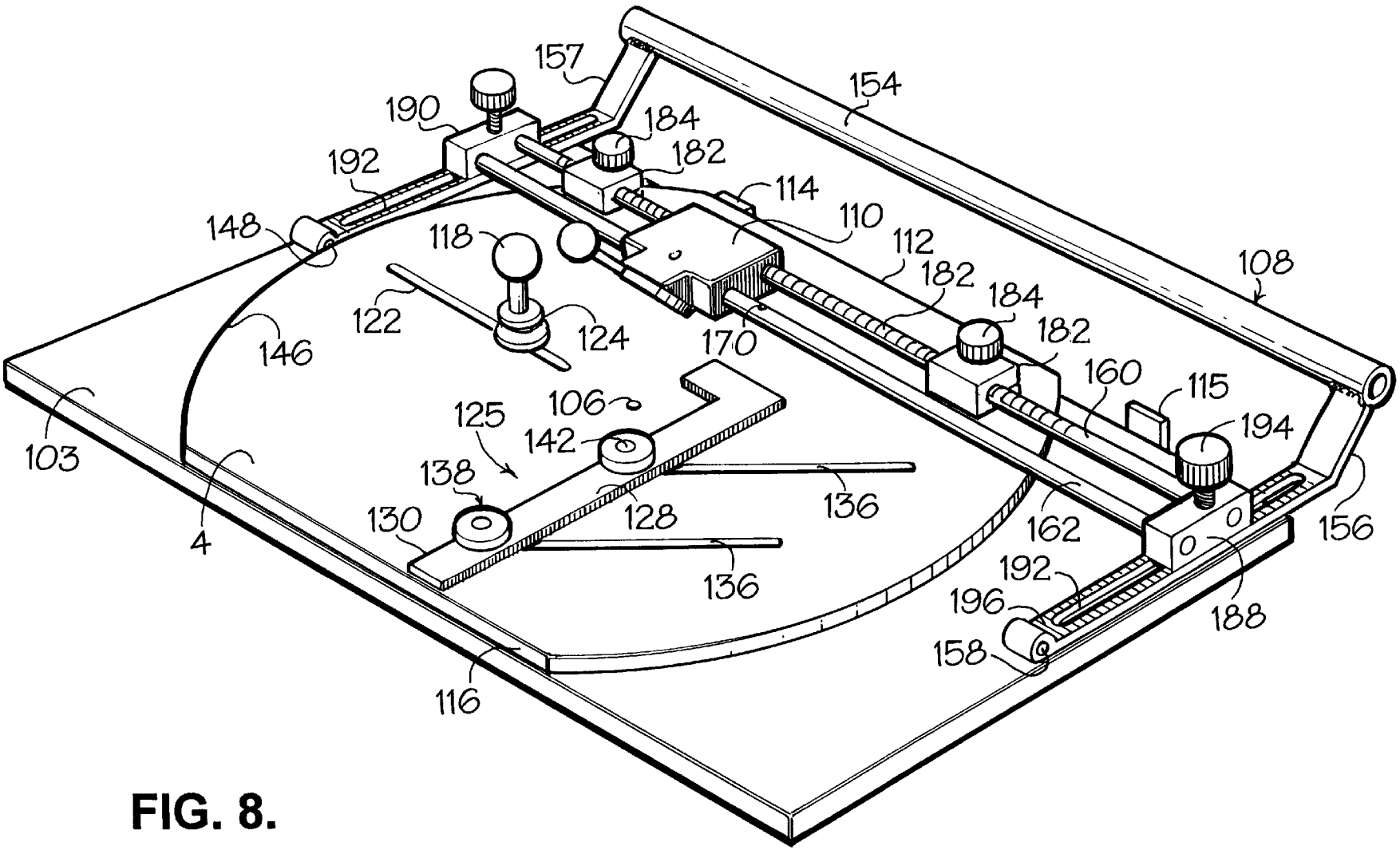
FIG. 8 is a perspective view of a second embodiment of cutting apparatus constructed in accordance with the present invention.

Referring to FIG. 8, the cutting apparatus of a second embodiment of the invention comprises a rectangular base support 103, on which is pivotally mounted a turntable 104, about pivot 106, a cutter support 108 which is pivotally mounted to the base support 103, and a cutter 110 which is slidably mounted on the cutter support 108.

The turntable 104 is substantially as shown in FIG. 8, with the pivot point 106 being laterally offset relative to the base support 103. The turntable 104, is rotatable through substantially 180°, i.e. from where its edge 112 contacts stopper 114, upstanding on base support 103 to where its opposite edge 116 contacts stopper 115 upstanding on base support 103. The turntable 104 may be manually rotated using handle 118.

Figure 9:
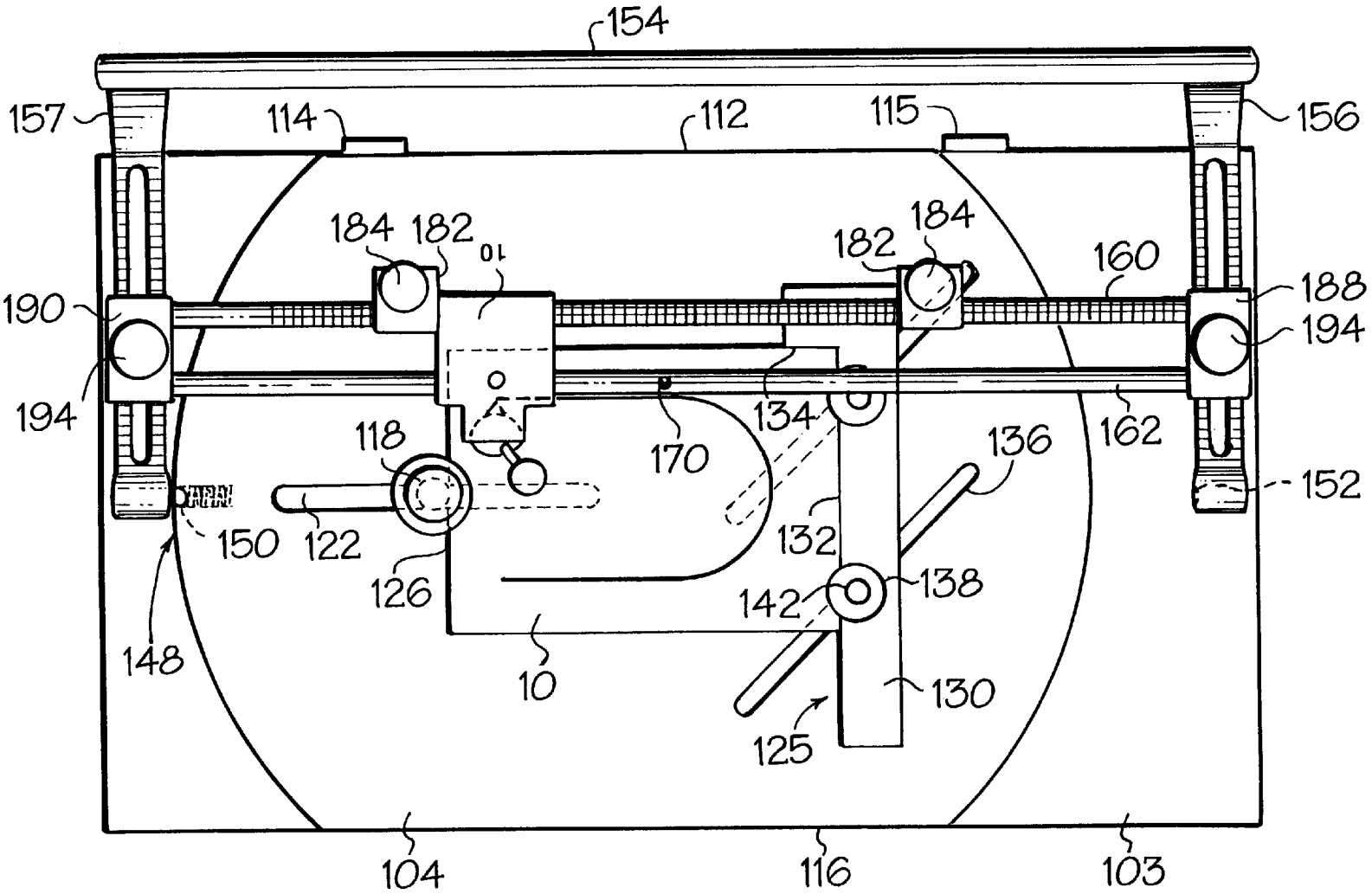
FIG. 9 is a plan view of the cutting apparatus of FIG. 8, but with a mountboard clamped to its turntable and a cathedral arch in the process of being cut into the mountboard by its cutter.

The handle 118 doubles as a clamp and together with clamping means 125 fixes a mountboard 120 (see FIG. 9) in place on the turntable 104. For this purpose, the handle 118 is slidable along slot 122 in the turntable 104. At the base of the handle 118, under the slot 122 and therefore not illustrated in the drawing, is a sliding block, this prevents the handle 118 from being pulled out of the slot 122. Above the slot 122 and mounted on the handle 118 is a flexible skirt or plunger 124. In use the skirt 124, when a lifting pressure is placed on the handle 118, releases its grip on the surface of the turntable 104 and facilitates the movement of the handle along the slot 122, it also raises sufficiently from its mounting on turntable 104 to allow the user of the cutting apparatus to place the edge 126 of the mountboard 10 thereunder. When the handle 118 is situated at the desired location along slot 122, the lifting pressure on the handle is released and the base of the skirt once again contacts the surface of the turntable 104. In this position, the handle 118 is fixed in place and clamps the mountboard 10 at the desired location. The handle 118 in this position can be used to rotate the turntable 104 without displacement from its fixed position.

The clamping means 125 comprises a substantially L-shaped rule 128, the edge 130 of which acts as an alignment edge for the edges 133, 134 of the mountboard 120. The rule 128 is slidably mounted in two parallel slots 136 in the turntable 104 via a pair of fastening means 138. Each of the fastening means 138 comprises a nut or knob 138, which rests on the L-shaped rule 128 and each of which protrude over the edge 130 of the rule 128 to provide a clamping point for the mountboard 120. Each of means 138 also has a shaft 142 which extends through the respective slot 136 and terminates in a sliding block (not illustrated) to hold the rule 128 in a slidable contact with the slots 136. When fastened, the fastening means fixes the rule 128 at a desired location. When the fastening means 138 are untightened by rotation, the rule 128 is slidable along the slots 136. Furthermore, a slot (not illustrated) is provided in the rule 128 for each of the fastening means 138 which allow the rule 128 to slide perpendicular to its slidable mounting in the slots 136 when the fastening means 138 is untightened.

At the edge 146 of the turntable 104, is a detent means 148 comprising a spring loaded ball bearing 150 and a corresponding aperture 152 in the cutter support 108. A similar aperture 152 is provided at the opposite side of the cutter support 108 and mates with the ball bearing 150 when the turntable is rotated through 180°.

The detent means 148, together with the stoppers 114, 115 provide a fixing or steadying means for the turntable 104 when the cutter 110 is used to cut a straight line in the mountboard 120.

Figure 10:
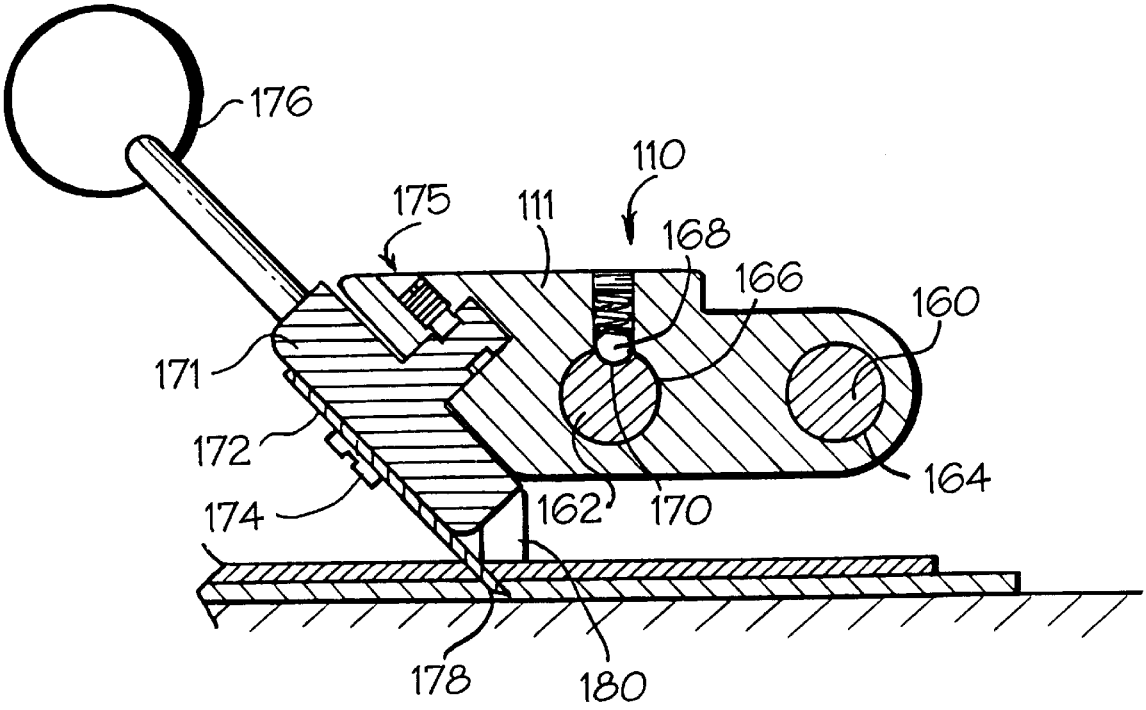
FIG. 10 is an enlarged view of the cutter of the cutting apparatus of FIG. 9 shown contacting the mountboard.

The cutter support 108 comprises a handle 154 having a pair of depending support arms 156, 157. Each of the arms 156, 157 is pivotally mounted to the base support 103 via a respective pivot point 158. A pair of rails 161, 162 extends between the arms 156, 157 above the turntable 104. As best illustrated in FIG. 10, the cutter 110 is slidably mounted on the rails via a pair of bores 164, 166 through its body 111. The cutter 110 is provided with a detent means 168 which comprises a spring loaded ball bearing which cooperates with an aperture 170 in support rail 162. The aperture 170 is opposite the pivot point 106 of the turntable 104. The detent means 168 are automatically engaged when the cutter 110 slides over and therefore into engagement with aperture 170.

The cutter 110 comprises a blade support 171 with a blade 172 removably fixed thereto by screw 174. The blade support 171 is spring loaded 175 with respect to the body 111 such that depression of its handle 176 brings the tip 178 of the blade 172 into cutting engagement with the mountboard 10. A non-stick strip 180 is situated at the base of the blade support 170 to flatten and steady the mountboard prior to cutting with the blade tip 178 of the blade 172. The strip 180 ensures that the blade 172 engages the mountboard with a constant cutting depth. The blade 172 is removable from its support 171 via its screw 174 for replacement or sharpening.

A pair of stoppers 182 are slidably mounted on rail 160 and can be fixed in position relative to the rail 160 by turning screw fitting 184. The stoppers 182 form a limiting means for movement of the cutter 110 along the rails 160,162. A scale 186 etched on rail 160 forms a guide for setting the position of the stoppers 182.

The rails 160, 162 are slidable along the arms 156, 157 via mounting means 188, 190 slidably mounted in a slot 192 in each arm 156, 157. Each mounting means 188, 190 can be fixed in position relative to its respective rail 160, 162 by turning its respective screw fitting 194. A scale 196 etched on each arm 156, 157 forms a guide for setting the position of the rails 162, 163 and hence the slidably mounted cutter 110.

It is to be noted that the handle 154 and the rails 160, 162 are above the level of the turntable such that the clamping means 125 can pass thereunder when the turntable 104 is rotated through 180°.

In use, a mountboard is clamped into position on the turntable 104 by the handle 118 and clamping means 125, after suitable adjustment of the handle and clamping means to firmly clamp in position the particular size of mountboard to be cut. The stoppers 182 are fixed, to limit the movement of the cutter 110 along the rails 160, 162, either side of the aperture 170. The distance of each stopper 182 from the aperture 170 determines the length of a straight edge 111 of the cathedral arch aperture 16 in the mountboard 10. The distance of each stopper either side of the aperture 170 is usually equal. The mounting means 188, 190 are fixed in position along the arms 156, 157 relative to the pivot point 106, to determine the width 198 of the cathedral arch 16. In order to cut the cathedral arch 16 in the mountboard 10, the cutter 110 is initially in abutment with one of the stoppers 182, the turntable 104 is fixed in position by stopper 118 contacting its edge 116 and detent means 148. The handle 176 of the cutter 110 is depressed so that the blade 172 cuts into the mountboard 10. The cutter 110 is then moved along the rails 160, 162 until it comes into automatic engagement with the aperture 170 via detent means 168. The cutter 110 is by this means fixed in position. The user then grasps the handle 118 of the turntable 104 and rotates the turntable 104, automatically releasing the detent means 148 and moves the turntable out of engagement with stopper 115, through 180° until the edge 112 of the turntable 104 is in engagement with stopper 114, and the detent means 148 is in engagement at the aperture 152 at the opposite arm 157 of the cutter support (the position of the turntable illustrated in FIGS. 8 and 9). Because the cutter blade 172 is in constant contact with the mountboard, the arch of the cathedral arch is cut in the mountboard as the turntable 104 rotates. Once the turntable is in engagement with the stopper 114, and the detent means engages the opposite aperture 152 of the cutter support 108, the turntable is once again fixed in position and the cutter 110 is manually pushed out of its engagement with aperture 170. The blade 172 then cuts the opposite straight edge of the cathedral arch aperture 16 by continuing the movement of the cutter 110 along the rails 160, 162 until it engages the opposite stopper 182.

In use, a second mountboard or card can be placed under the mountboard 10 to be cut in order to protect the surface of the turntable from the blade tip 178.

The invention is not limited to the above described embodiment. For example, although a mountboard has been described any sheet material, such as paper, card, plastics etc. could be so cut. Furthermore, a cathedral arch aperture has been described, but other apertures, or indeed shapes may be cut combining straight and/or curved edges. Although two support rails 160, 162 have been described, one or more could be used. The bevelled edge cut could be adjustable by providing a tilting means for the blade of the cutter. The stoppers 182 could be supported by both rails 160, 162 to provide greater stability. The L-shaped rule 125 could be replaced by a clamping means adapted to fit the edge of the card to be cut. Further numerous modifications and changes will readily occur to those skilled in the art.

The above description is not meant to describe in detail each and every modification and variation which will be apparent to a person skilled in the art. It is however, meant to include all such modifications and variation within the scope of the following claims.

What is claimed is:

1. An apparatus for cutting a mountboard, comprising a pivotally mounted turntable upon which, in use, the mountboard to be cut is mounted, a cutter guide mounted above the turntable, a cutter movable along the cutter guide, and means for engaging the turntable to limit the rotation of the turntable relative to said cutter guide, wherein said turntable rotates relative to said cutter guide to facilitate cutting an arc in the mountboard.

2. An apparatus as claimed in claim 1, wherein the turntable is rotatable through at least 180°.

3. An apparatus as claimed in claim 1, further including at least one stopper, mounted on the cutter guide to limit the travel of the cutter.

4. An apparatus as claimed in claim 3, wherein said at least one stopper is adjustable.

5. An apparatus as claimed in claim 3, wherein said at least one stopper is movable out of the path of the cutter.

6. An apparatus as claimed in claim 1, wherein the turntable is mounted on a base and the cutter guide is adjustable with respect to the base.

7. An apparatus as claimed in claim 1, further comprising means for releasably supporting the mountboard on the turntable.

8. An apparatus as claimed in claim 1, wherein the cutter guide comprises a substantially straight edge.

9. An apparatus as claimed in claim 1, wherein the cutter has a blade with an adjustable offset for cutting a bevelled edge in the mountboard.

10. An apparatus for cutting a mountboard, comprising a pivotally mounted turntable upon which, in use, the mountboard to be cut is mounted, a cutter guide mounted above the turntable, a cutter movable along the cutter guide, means for engaging the turntable to limit the rotation of the turntable relative to said cutter guide, wherein said turntable rotates relative said cutter guide to facilitate cutting an arc in the mountboard, and clamping means which at least partially extends over the mountboard to hold it in place during the cutting operation.

11. An apparatus as claimed in claim 10, in which the clamping means includes a handle which is used to rotate the turntable.

12. An apparatus as claimed in claim 10, in which the clamping means forms an alignment means for aligning the mountboard.

13. An apparatus as claimed in claim 10, wherein the cutter guide is mounted slidably over the turntable.

14. An apparatus as claimed in claim 10, wherein the cutter is attached to the cutter guide.

15. An apparatus as claimed in claim 10, wherein the cutter has a spring loaded blade which cuts into the mountboard when pressure is applied to the cutter and a smoothing means which contacts the surface of the mountboard.

16. An apparatus as claimed in claim 10, wherein a detent means is provided on the cutter to form a removable stopper for the cutter.

17. An apparatus as claimed in claim 10, wherein the turntable has at least one detent means which holds the turntable in place when the turntable engages the turntable engaging means.

* * * * *